US011554301B2

(12) United States Patent
Yamamoto

(10) Patent No.: US 11,554,301 B2
(45) Date of Patent: Jan. 17, 2023

(54) GOLF CLUB HEAD AND GOLF CLUB KIT

(71) Applicant: SUMITOMO RUBBER INDUSTRIES, LTD., Hyogo (JP)

(72) Inventor: Akio Yamamoto, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/316,863

(22) Filed: May 11, 2021

(65) Prior Publication Data

US 2021/0370147 A1 Dec. 2, 2021

(30) Foreign Application Priority Data

May 27, 2020 (JP) ..... JP2020-092569

(51) Int. Cl.
*A63B 53/04* (2015.01)
*A63B 53/08* (2015.01)
*A63B 53/06* (2015.01)

(52) U.S. Cl.
CPC ..... *A63B 53/08* (2013.01); *A63B 53/0466* (2013.01); *A63B 53/06* (2013.01); *A63B 2053/0491* (2013.01); *A63B 2225/01* (2013.01)

(58) Field of Classification Search
CPC ... A63B 53/022; A63B 53/023; A63B 53/025; A63B 53/026; A63B 53/027; A63B 53/028; A63B 53/04; A63B 53/0416; A63B 53/042; A63B 53/0425; A63B 53/0429; A63B 53/0466; A63B 53/06; A63B 53/08
USPC ..... 473/324–350
See application file for complete search history.

(56) References Cited

U.S. PATENT DOCUMENTS 1,349,805 A * 8/1920 Booth ..... A63B 53/04 473/342
1,361,957 A * 12/1920 Bernays ..... A63B 53/08 473/343
8,348,786 B2 * 1/2013 Nakano ..... A63B 60/02 473/348
8,414,422 B2 * 4/2013 Peralta ..... A63B 53/04 473/335
10,166,444 B1 * 1/2019 Forshner ..... A63B 60/52
2006/0172816 A1 * 8/2006 Johnson ..... A63B 60/02 473/307
2011/0021283 A1 * 1/2011 Hatton ..... A63B 60/00 473/409
2018/0036605 A1 * 2/2018 Tassistro ..... B21K 17/00
2019/0262674 A1 * 8/2019 Tassistro ..... A63B 53/047
2020/0368591 A1 * 11/2020 Hebreo ..... A63B 53/0466
2021/0197044 A1 * 7/2021 Morales ..... A63B 60/00
(Continued)

FOREIGN PATENT DOCUMENTS

CA 3030222 A1 * 1/2018 ..... A63B 1/00
JP 2000-288131 A 10/2000

*Primary Examiner* — Alvin A Hunter
(74) *Attorney, Agent, or Firm* — Greenblum & Bernstein, P.L.C.

(57) ABSTRACT

A golf club head includes a head main body, and a toe-side component. The head main body includes a striking face, a hosel portion defining a shaft center line, and a mounting portion for mounting the toe-side component on a toe side with respect to the shaft center line. The toe-side component is fixed to the mounting portion removably. When the toe-side component is removed from the mounting portion of the head main body, a head projected area in a front view of the golf club head becomes smaller.

19 Claims, 8 Drawing Sheets

(56) References Cited

U.S. PATENT DOCUMENTS

| | | | | |
|---|---|---|---|---|
| 2021/0331042 | A1* | 10/2021 | Gonzalez | A63B 53/0416 |
| 2021/0339095 | A1* | 11/2021 | Tassistro | A63B 53/0475 |

* cited by examiner

GOLF CLUB HEAD AND GOLF CLUB KIT

RELATED APPLICATION

This application claims the benefit of foreign priority to Japanese Patent Application No. JP2020-092569, filed May 27, 2020, which is incorporated by reference in its entirety.

BACKGROUND ART

Field of the Disclosure

The present disclosure relates to a golf club head and a golf club kit.

Description of the Related Art

When golfers hit a ball with a golf club, golfers first hold the striking face of the golf club head toward the target direction (address). Then, golfers swing the golf club up (takeback) and then swings it down (downswing). In these series of swing movements, if the ball can be hit in the state when the striking face was at address, the hit ball will fly in the intended target direction. Note that in the explanation of this specification, right-handed golfers are assumed.

Patent Document

[Patent Document 1] Japanese Unexamined Patent Application Publication 2000-288131

SUMMARY OF THE DISCLOSURE

By the way, in the downswing, the striking face may not return to the state when it was at address. In this case, the striking face may hit the ball while facing to the right of the target direction (hereinafter referred to as the striking face is open), and the hit ball tends to fly to the right side with respect to the target direction.

On the contrary, in the downswing, the striking face may return beyond the state when it was at address. In this case, the striking face may hit the ball while facing to the left of the target direction (hereinafter referred to as the striking face is closed), and the hit ball tends to fly to the left side of the target direction.

In this way, when the ball is hit with the striking face open or closed, the hit ball cannot be flown in the target direction.

The inventor focused on the air resistance of the golf club head during downswing, and has completed a golf club head that can adjust the degree of opening of the striking face during the downswing by making this air resistance adjustable.

The present disclosure has a major object to provide a golf club head and a golf club kit capable of adjusting the flight direction of a hit ball.

In one aspect of the disclosure, a golf club head includes a head main body, and a toe-side component, wherein the head main body includes a striking face, a hosel portion defining a shaft center line, and a mounting portion for mounting the toe-side component on a toe side with respect to the shaft center line, the toe-side component is fixed to the mounting portion removably, and when the toe-side component is removed from the mounting portion of the head main body, a head projected area in a front view of the golf club head becomes smaller.

In another aspect of the disclosure, in the front view of the golf club head, the mounting portion may have a recessed contour toward the shaft center line.

In another aspect of the disclosure, the toe-side component may be fixed to the mounting portion using a screw.

In another aspect of the disclosure, a ratio (A1/A2) of a head projected area A1 when the toe-side component is fixed to the mounting portion to a head projected area A2 when the toe-side component is removed from the mounting portion may be in a range of 1.02 to 1.12.

In another aspect of the disclosure, the toe-side component may include a low specific gravity material having a specific gravity lower than a specific gravity of the head main body.

In another aspect of the disclosure, a ratio (B1/B2) of a head projected area B1 in a plan view of the golf club head when the toe-side component is fixed to the mounting portion to a head projected area B2 in the plan view of the golf club head when the toe-side component is removed from the mounting portion may be in a range of 1.0 to 1.05.

In another aspect of the disclosure, in a plan view of the golf club head where the toe-side component is removed from the mounting portion, the mounting portion may be provided in an invisible position.

In another aspect of the disclosure, in a plan view of the golf club head where the toe-side component is fixed to the mounting portion, the toe-side component may be provided in an invisible position.

In another aspect of the disclosure, when the golf club head with the toe-side component fixed to the mounting portion is placed on a horizontal plane, the toe-side component may be provided at a position where the toe-side component does not come into contact with the horizontal plane.

In another aspect of the disclosure, a golf club kit may include a head main body, and a plurality of toe-side components, wherein the head main body includes a striking face, a hosel portion defining a shaft center line, and a mounting portion for mounting the toe-side component on a toe side with respect to the shaft center line, the plurality of toe-side components is capable of fixed to the mounting portion interchangeably with each other, the plurality of toe-side components includes a first component and a second component, the first component provides a first head projected area in a front view of the golf club head when fixed to the mounting portion, and the second component provides a second head projected area that is larger than the first head projected area in a front view of the golf club head when fixed to the mounting portion.

In another aspect of the disclosure, the second component may have a substantially same weight as the first component.

In another aspect of the disclosure, the golf club kit may further include a weight member that has a substantially same weight as the first component, wherein the weight is capable of being fixed to the mounting portion removably.

In another aspect of the disclosure, the plurality of toe-side components and the weight member may be capable of being fixed to the mounting portion using a common screw and a same screw hole.

DETAILED DESCRIPTION OF EMBODIMENTS

Figure 1:
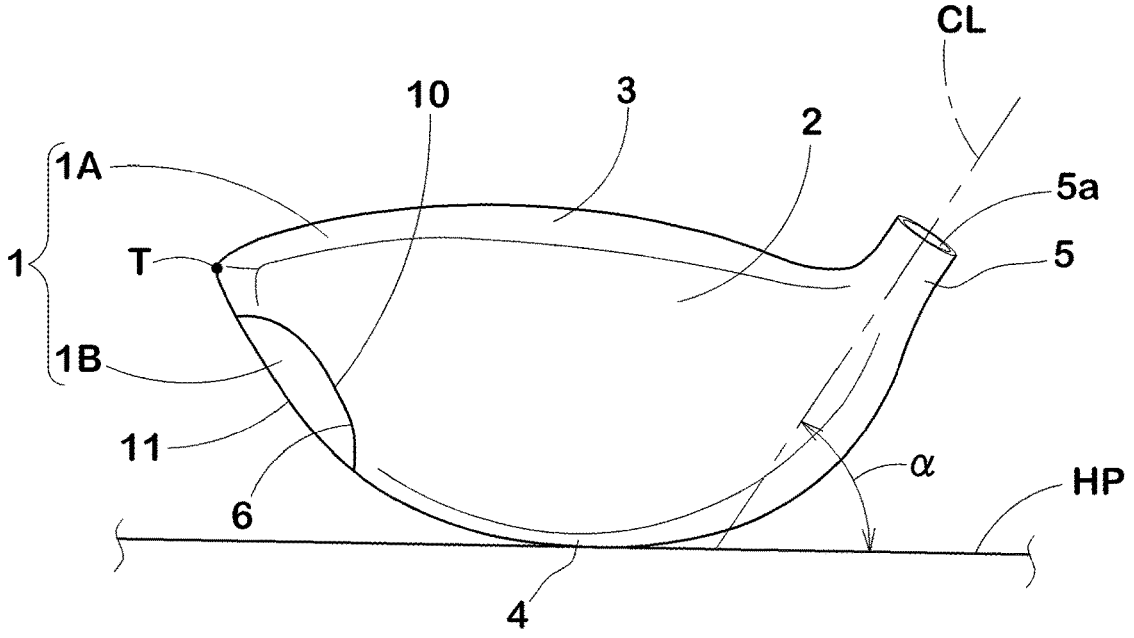
FIG. 1 is a front view of an exemplary golf club head in accordance with one aspect of the present disclosure.

One or more embodiments of the present disclosure will be explained below with reference to the accompanying drawings.

Note that the drawings may contain exaggerated expressions and expressions different from the dimensional ratio of the actual structure in order to help the understanding of the present disclosure. Further, the same or common elements are denoted by the same reference numerals throughout the specification, and duplicate explanations are omitted. Furthermore, note that the embodiments and the specific configurations shown in drawings are for understanding the contents of the present disclosure, and the present disclosure is not limited to the specific configurations shown.

FIGS. 1 to 4 respectively illustrate a front view, a side view, a bottom view and a plan view of an exemplary golf club head (hereafter, simply referred to as "head") 1 in accordance with one aspect of the present disclosure. Further, FIGS. 5 and 6 respectively illustrate perspective view of the exemplary head 1 viewed from above and bottom. Furthermore, FIG. 7 illustrates an exploded perspective view of the exemplary head 1.

[Definition of Reference State and the Like]

Figure 2:
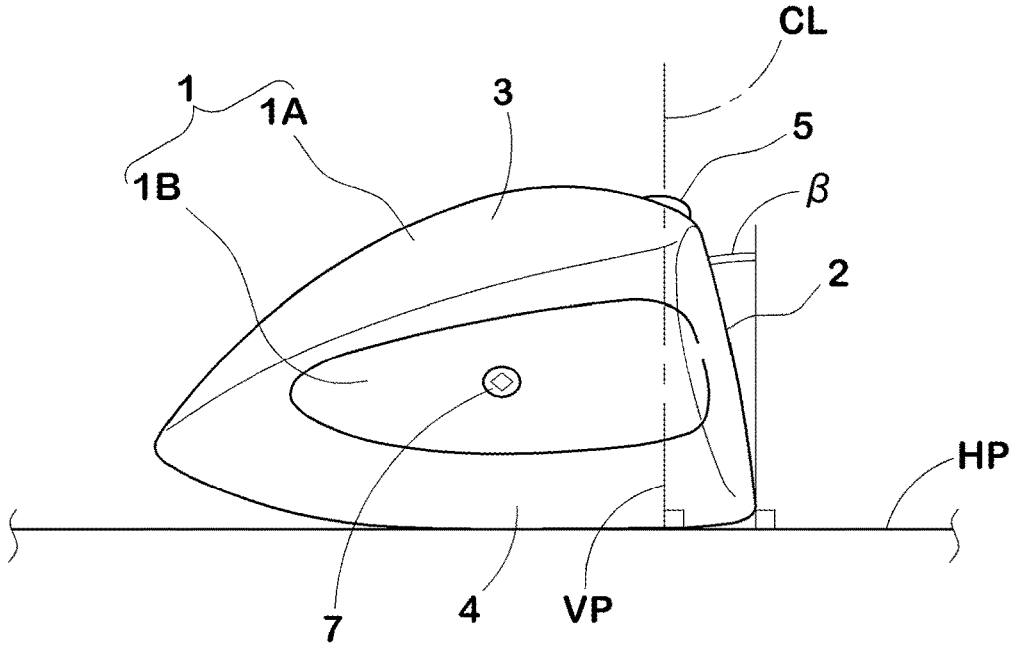
FIG. 2 is a side view of the exemplary golf club head viewed from the toe side in accordance with one aspect of the present disclosure.
Figure 3:
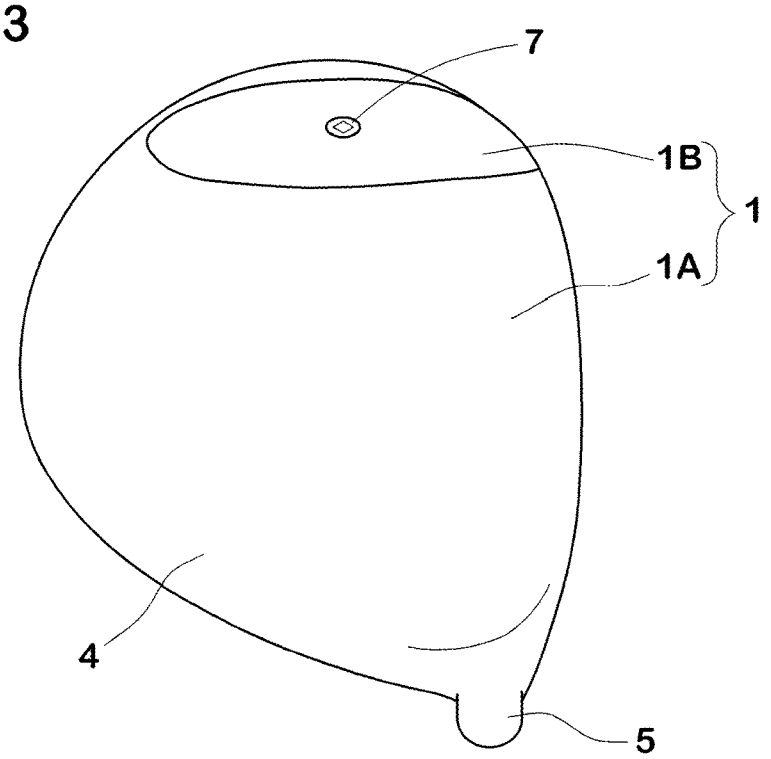
FIG. 3 is a bottom view of the exemplary golf club head in accordance with one aspect of the present disclosure.

In FIGS. 1 to 4, the head 1 is oriented in a reference state. As used herein, the reference state of the head 1 is the state in which the head 1 is placed on a horizontal plane HP at its lie angle α (FIG. 1) and its loft angle β (FIG. 2) of the head 1. In detail, as illustrated in FIG. 2, in the reference state, a shaft center line CL of the head 1 lies in a reference vertical plane VP, and the head 1 is oriented at the lie angle α and the loft angle β.

As used herein, the shaft center line CL is defined by an axis centerline of a shaft insertion hole 5*a* formed in a hosel portion 5 of the head 1. Unless otherwise specified, the head 1 is explained as being oriented in the reference state.

Further, in the reference state of the head 1, a head front-rear direction is defined as the direction that is orthogonal to the reference vertical plane VP. With respect to the head front-rear direction of the head 1, a side of the striking face 2 is the front side, and the opposite side is the rear side. Furthermore, a toe-heel direction is the direction that is parallel to both the reference vertical plane VP and the horizontal plane HR Furthermore, a head vertical direction is the direction that is orthogonal to the horizontal plane HR

[Basic Structure of Head]

As is clear from FIGS. 1 to 6, the head 1 in accordance with the present embodiment is configured as, for example, a wood-type golf club head. The wood-type golf club head 1, for example, includes heads called driver, fairway wood, etc. In another embodiments, the head 1 may be configured as iron-type, hybrid-type or putter-type club heads.

The head 1 in accordance with the present embodiment includes a head main body 1A and a toe-side component 1B.

[Head Main Body]

The head main body 1A, for example, integrally includes the striking face 2, a crown 3, a sole 4, the hosel portion 5 and the like, and has a hollow portion (not illustrated) therein.

The striking face 2 is formed on the front side of the head 1 and constitutes the surface for striking a ball. Although not shown, the striking face 2 may be provided with a plurality of grooves called face lines extending in the toe-heel direction.

The crown 3 extends from an upper edge of the striking face 2 toward the rear of the head, and the outer surface of the crown 3 forms an upper surface of the head. The hosel portion 5 is provided on the heel side of the crown 3. The shaft insertion hole 5*a* for fixing a club shaft (not illustrated) is formed in the hosel portion 5.

The sole 4 extends from a lower edge of the striking face 2 toward the rear of the head, and the outer surface of the sole 4 forms a bottom surface of the head.

The head main body 1A, for example, is made of metallic material. As the metallic material, stainless steel, maraging steel, titanium alloy, magnesium alloy, aluminum alloy, etc. are suitable, for example. Alternatively, a part of the head 1 (e.g., the crown 3) may be made of a non-metallic material such as fiber reinforced plastic.

[Mounting Portion of Head Main Body]

Figure 9:
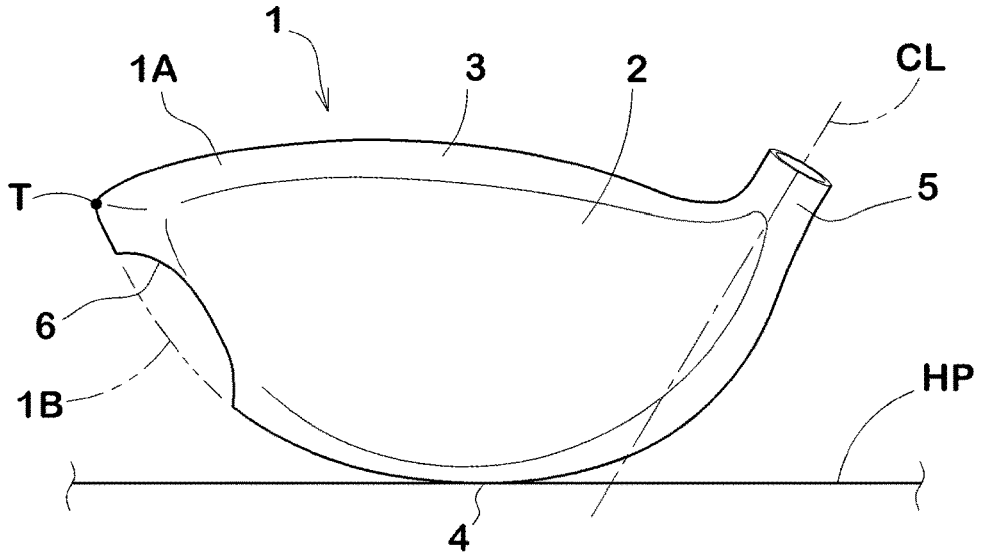
FIG. 9 is a front view of the exemplary golf club head with a toe-side component removed in accordance with one aspect of the present disclosure.

FIG. 9 illustrates a front view of the head 1 with the toe-side component 1B removed. As used herein, the "front view of the head" is a view in which the head 1 is viewed from the side of the striking face 2 in a direction orthogonal to the reference vertical plane VP.

As illustrated in FIG. 1 and FIG. 9, in the front view, the head main body 1A includes a mounting portion 6 on the toe T side with respect to the shaft center line CL. As used herein, the term "toe" means the tip on the opposite side of the shaft center line CL in the front view of the head. In the present embodiment, the outline of the mounting portion 6 is visible in the front view of the head. The mounting portion 6, for example, is formed on a toe portion of the head 1. As used herein, the "toe portion" is a part between the crown 3 including the toe T and the sole 4. Thus, the toe portion is located far from the shaft center line CL. In another embodiment, the mounting portion 6 may be provided at a different position from the toe portion.

The mounting portion 6 in accordance with the present embodiment has a recessed contour toward the shaft center line CL side, for example. In some preferred embodiments, the mounting portion 6, for example, has an arc-shape contour recessed toward the shaft center line CL. This contour is in contrast to the contours of the crown 3 and the sole 4, which are smoothly convex toward the outside of the head. Alternatively, the contour of the mounting portion 6 in the front view of the head may be in various forms other than the illustrated aspect.

As apparent from FIG. 7, the mounting portion 6 in accordance with the present embodiment extends in the head front-rear direction. Further, the mounting portion 6, for example, is provided with a screw hole 8 in a central portion thereof.

[Toe-Side Component]

Figure 6:
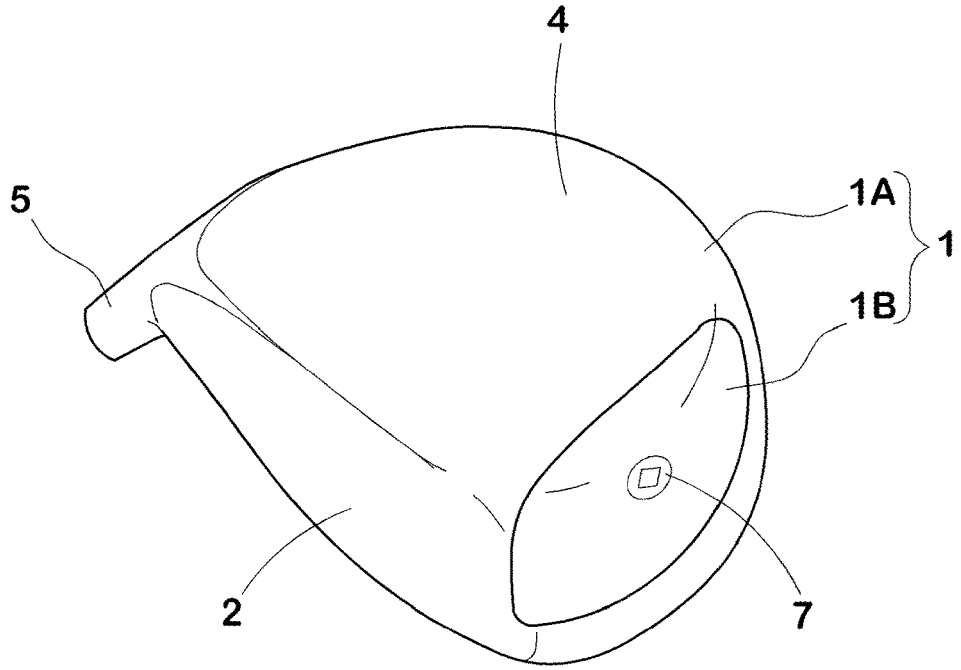
FIG. 6 is a perspective view of the exemplary golf club head viewed from bottom in accordance with one aspect of the present disclosure.
Figure 7:
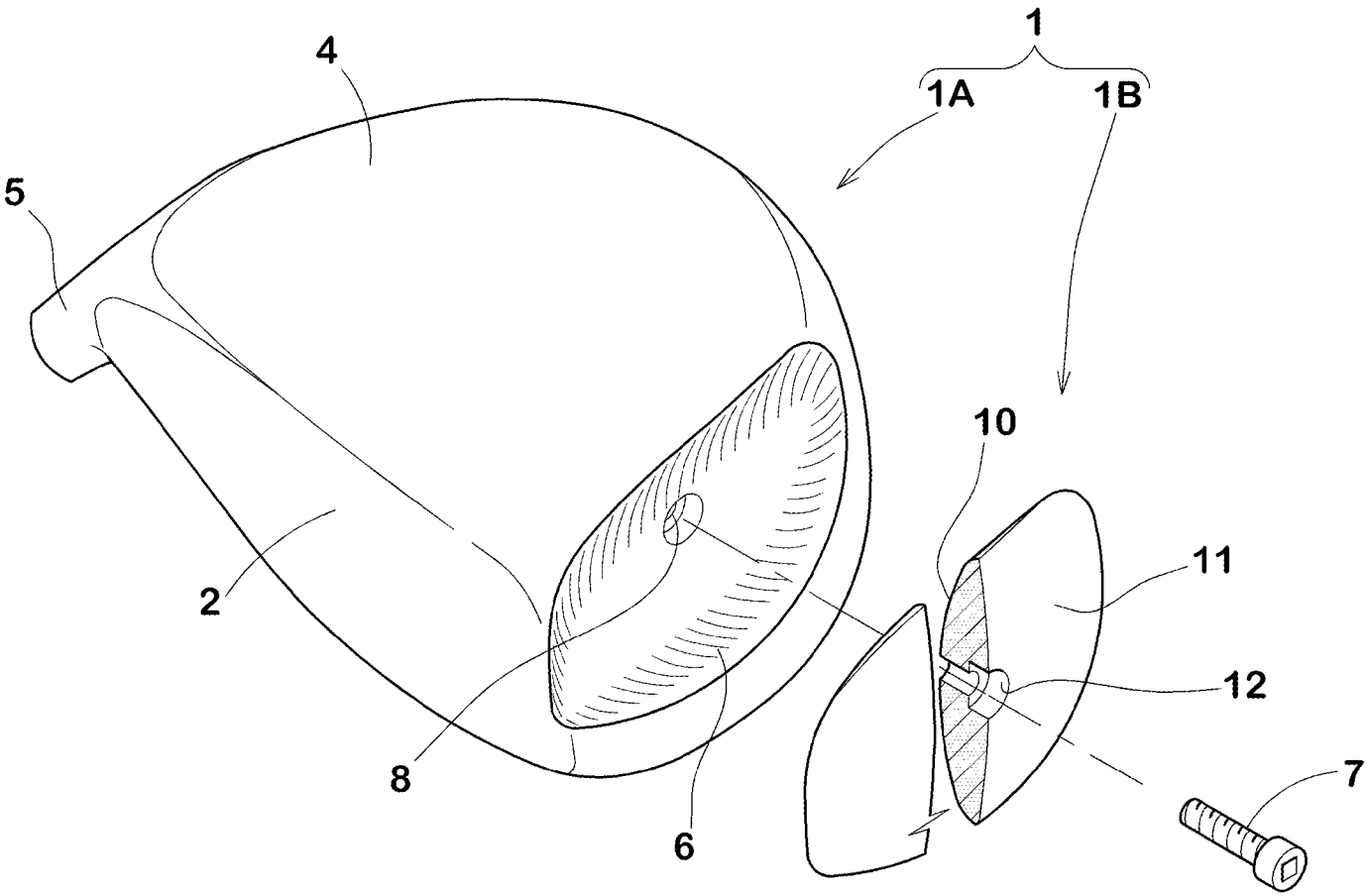
FIG. 7 is an exploded perspective view of the exemplary golf club head in accordance with one aspect of the present disclosure.

As apparent from FIG. 6 and FIG. 7, the toe-side component 1B is fixed to the mounting portion 6 removably. In the present embodiment, the toe-side component 1B is fixed to the mounting portion 6 using a screw 7 as a fastener. As used herein, "screw" includes all devices that can fasten two members together by being given a rotational force. Thus, note that the screw 7 in accordance with the present embodiment includes not only a screw having a continuous spiral thread groove as shown, but also a one-touch type screw that can fasten two members with a small rotation amount of about 90 degrees, for example.

Figure 4:
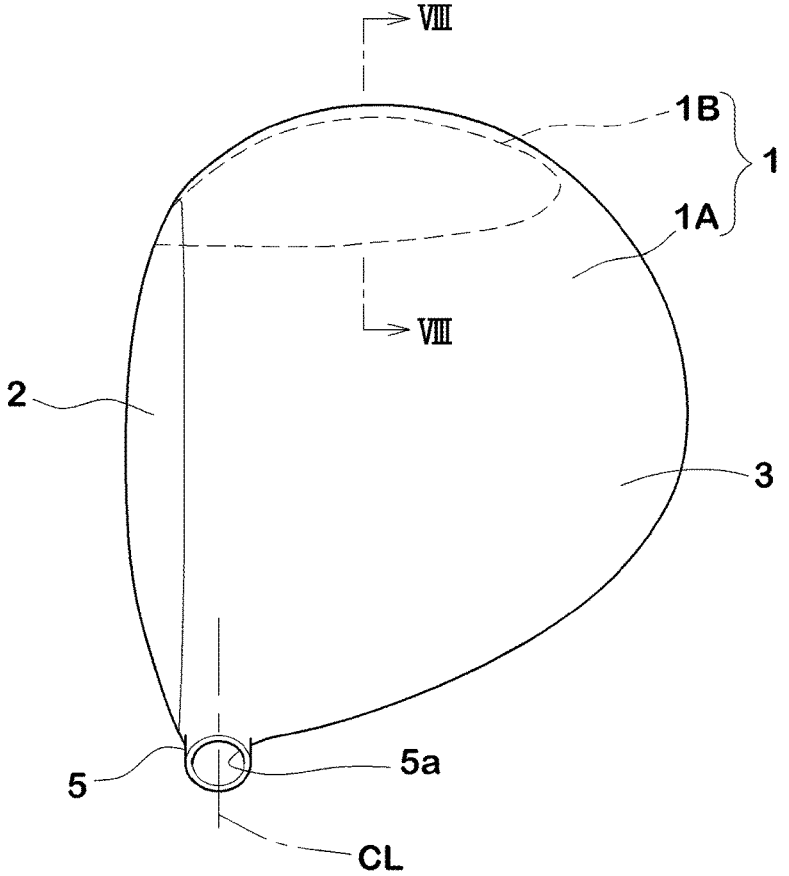
FIG. 4 is a plan view of the exemplary golf club head in accordance with one aspect of the present disclosure.
Figure 5:
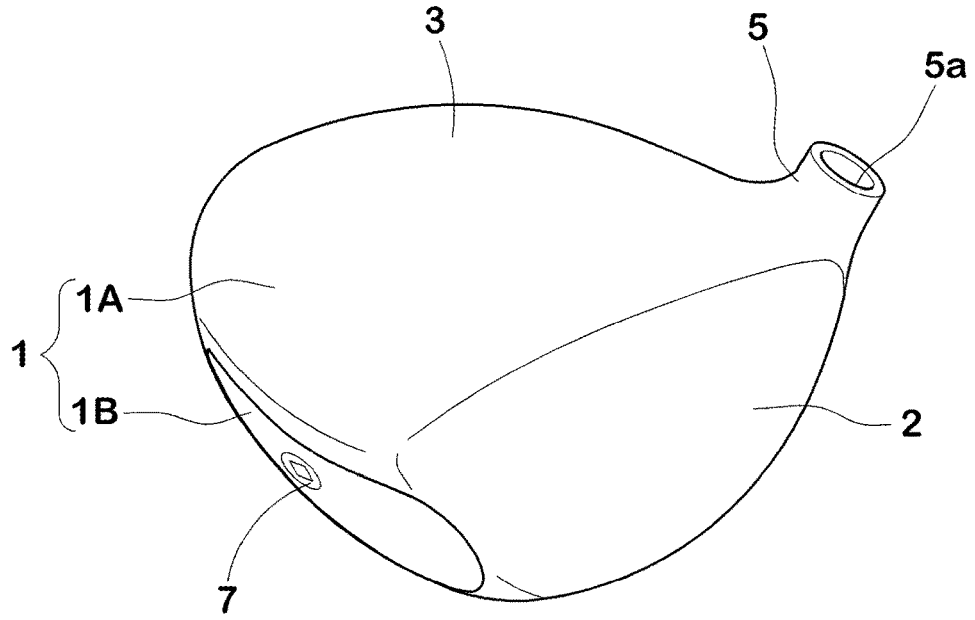
FIG. 5 is a perspective view of the exemplary golf club head viewed from above in accordance with one aspect of the present disclosure.
Figure 8:
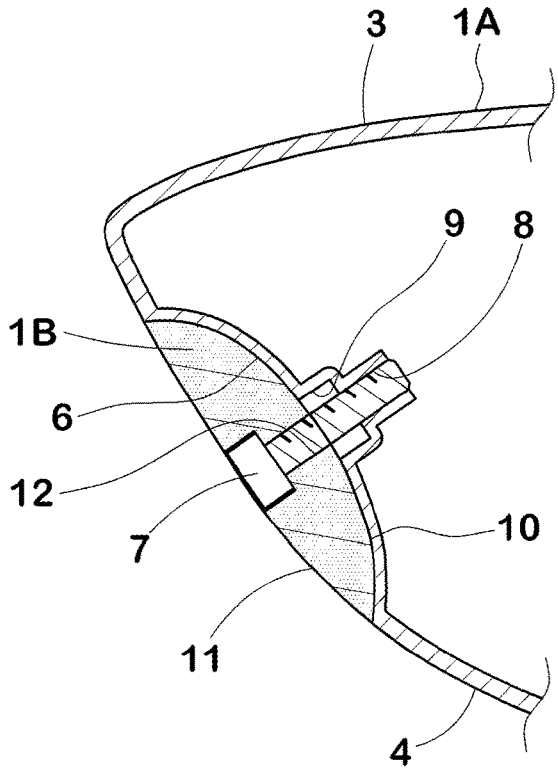
FIG. 8 is a cross-sectional view taken along the lines VIII-VIII of FIG. 4.

FIG. 8 illustrates a cross-sectional view taken along the lines VIII-VIII of FIG. 4. As illustrated in FIG. 7 and FIG. 8, the toe-side component 1B in accordance with the present embodiment, for example, includes an inner surface 10 facing to the mounting portion 6, an outer surface 11 opposite the inner surface 10, and a through hole 12 extending from the inner surface 10 to the outer surface 11. The inner surface 10 of the toe-side component 1B is formed along an outer surface of the mounting portion 6, the for example. Also, the outer surface 11 of the toe-side component 1B, when being fixed to the mounting portion 6, is continuous with the crown 3 and the sole 4 of the head main body 1A to form an outer surface of the head.

The screw 7 is inserted into the through hole 12 of the toe-side component 1B. Then, the screw 7 is fixed to the screw hole 8 provided in the mounting portion 6. Thus, the toe-side component 1B can be easily removed from the mounting portion 6 by removing the screw 7 from the screw hole 8. Also, by placing the toe-side component 1B on the mounting portion 6 and fixing the screw 7 in the screw hole 8, the toe-side component 1B is easily fixed to the mounting portion 6 of the head main body 1A. In this way, general golfers can easily fix and remove the toe-side component 1B with respect to the head main body 1A without a special tool or equipment.

[Head Projected Area]

As apparent from FIG. 9, in the head 1 in accordance with the present embodiment, when the toe-side component 1B is removed from the head main body 1A, a head projected area in the front view of the head becomes smaller. That is, by removing the toe-side component 1B indicated by a virtual line from the mounting portion 6 of the head main body 1A, the head projected area is reduced by a projected area of the toe-side component 1B. Here, "head projected area in the front view of the head" is an area of a projection view in which the head 1 is projected on a plane parallel to the reference vertical plane VP located behind the head 1 in the front view of the head as shown in FIG. 1 and FIG. 9.

As a result of various experiments, the inventor has found that the degree of opening of the striking face 2 during downswing is affected by air resistance of the head 1. Specifically, during downswing, the head 1 makes a rotational movement around the shaft center line CL gradually so as to close the striking face 2. Unfortunately, this rotational motion is suppressed as the air resistance of the head 1 (especially the air resistance on the toe side) increases. Further, the air resistance of the head 1 increases as the head projected area in the front view of the head increases.

In the head 1 in accordance with the present embodiment, the toe-side component 1B is removable to the head main body 1A. Thus, the head 1 in accordance with the present embodiment can be used either in the state of the head main body 1A alone or in the state of an assembly in which the toe-side component 1B is fixed to the head main body 1A. For example, when the toe-side component 1B is removed from the head main body 1A, i.e., when the head main body 1A is used alone, the head projected area becomes relatively small, resulting in reducing the air resistance on the toe side of the head 1 during downswing. As a result, the head 1 in this usage is relatively easy to close the striking face 2 during downswing.

On the other hand, when the toe-side component 1B is fixed to the head main body 1A, i.e., when the head is used as the assembly of the head main body 1A and the toe-side component 1B, the head projected area becomes relatively large, resulting in increasing the air resistance on the toe side of the head 1 during downswing. As a result, the head 1 in this usage is relatively difficult to close the striking face 2 during downswing.

For example, for golfers whose hit ball tends to fly to the right side relative to the target direction, it may be preferably to use the head 1 with the present embodiment with the toe-side component 1B removed. This is because such a head 1 has a relatively reduced air resistance of the head 1 during downswing, and thus the striking face 2 is relatively easy to close.

On the other hand, for golfers whose hit ball tends to fly to the left side relative to the target direction, it may be preferably to use the head 1 with the present embodiment with the toe-side component 1B fixed. This is because such a head 1 has a relatively increased air resistance of the head 1 during downswing, and thus the striking face 2 is relatively difficult to close.

As described above, the head 1 in accordance with the present embodiment can easily adjusted the flight direction of the hit ball.

Here, when the projected area of the toe-side component 1B in the front view of the head is excessively small, the above-mentioned effect may not be sufficiently obtained. On the contrary, when the projected area of the toe-side component 1B is excessively large, the air resistance becomes too large and it may be difficult to close the striking face 2 during downswing. Although not particularly limited, a ratio (A1/A2) of the head projected area A1 when the toe-side component 1B is fixed to the head main body 1A to the head projected area A2 when the toe-side component 1B is removed from the head main body 1A is preferably in a range of 1.02 to 1.12.

The toe-side component 1B in accordance with the present embodiment, in a front view of the head, is formed so as not to includes the striking face 2. Thus, such a head 1 is desirable in that a certain striking face area is secured regardless of the presence or absence of the toe-side component 1B. In other embodiments, the toe-side component 1B may form a part of the striking face 2.

The volume of the toe-side component 1B is not particularly limited, but the total head volume when the toe-side component 1B is fixed to the mounting portion 6 is, for example, equal to or less than 500 cc, more preferably equal to or less than 460 cc. Further, when the volume of the toe-side component 1B is too large, there is a risk that shot feeling (feeling of hitting, hitting sound, etc.) will change significantly between when it is attached and when it is removed. From this viewpoint, the volume of the toe-side component 1B is preferably equal to or less than 100 cc, more preferably equal to or less than 90 cc, still further preferably equal to or less than 80 cc. On the other hand, in order to adjust the opening degree of the striking face 2 to a certain practical range, the toe-side component 1B needs a certain volume. From this viewpoint, the volume of the toe-side component 1B is preferably 1 equal to or more than 10 cc, more preferably equal to or more than 20 cc, still further preferably equal to or more than 30 cc.

The toe-side component 1B may be made of various materials. In some preferred embodiments, the toe-side component 1B may be formed of a low specific gravity material with a specific gravity lower than a specific gravity of the head main body 1A. As the low specific gravity material, it is desirable that the specific gravity is equal to or less than 2.0, more preferably equal to or less than 1.5, still further preferably equal to or less than 1.0. As such a low specific gravity material, for example, resin, elastomer, fiber reinforced resin, porous sponge, etc. may be used. The toe-side component 1B made of low specific gravity material is lightweight. Such a toe-side component 1B can reduce the weight change of the head 1 before and after being attached to the head main body 1A, and be helpful to provide the same swing feeling.

Figure 10:
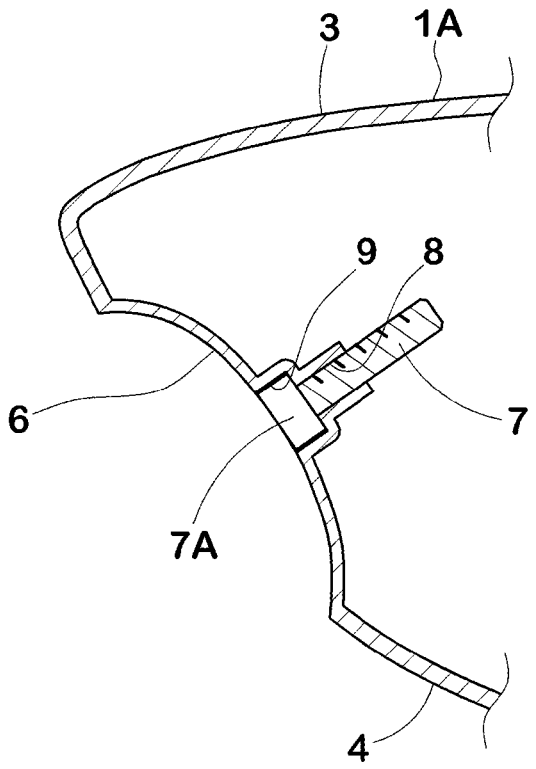
FIG. 10 is a partial cross-sectional view of the exemplary golf club head with the toe-side component removed in accordance with one aspect of the present disclosure.

FIG. 10 is a partial cross-sectional view of the head 1 with the toe-side component 1B removed from the mounting portion 6 (corresponding to the lines VIII-VIII in FIG. 4). In this embodiment, the screw 7 is fixed to the screw hole 8 of the mounting portion 6. This allows the screw hole 8 of the head main body 1A to be closed. Further, fixing the screw 7 to the head main body 1A with or without the toe-side component 1B helps to reduce changes in head weight.

Furthermore, in the embodiment shown in FIG. 10, the screw hole 8 of the mounting portion 6 may have a recess 9 capable of accommodating the screw head 7A of the screw 7 so as not to protrude from the mounting portion 6. Such a structure is preferable in that the shape of the mounting portion 6 in the front view of the head does not change significantly in the head 1 with the toe-side component 1B removed.

As illustrated in FIGS. 1 to 4, the toe-side component 1B is preferably provided on a position so as not to come into contact with the horizontal HP when the head 1 with the toe-side component 1B fixed to the mounting portion 6 is placed on the horizontal HR Such a head 1 can position at address with the same feeling as with or without the toe-side component 1B, and can reduce the chance of the toe-side component 1B coming into contact with the ground during swing.

In the head 1 according to the present embodiment, it is preferable that the change in head shape is small between when the toe-side component 1B is fixed to the head main body 1A and when it is removed from the head main body 1A. In particular, it is preferable that the change in the head shape at address is small. If the head shape that can be seen at address changes significantly, it gives the golfer a sense of discomfort.

The change in head shape at address as described above may be evaluated by comparing a head projected area in a plan view of the head. As used herein, the "projected area of the head in a plan view of the head" means the area of a head projected view in which the head 1 is projected on the horizontal plane HP in a head plan view such as FIG. 4. In some preferred embodiments, a ratio (B1/B2) of a head projected area B1 in a plan view of the head 1 when the toe-side component 1B is fixed to the mounting portion 6 of the head main body 1A to a head projected area B2 in the plan view of the golf club head when the toe-side component 1B is removed from the mounting portion 6 of the head main body 1A is preferably in a range of 1.0 to 1.05. By setting the ratio (B1/B2) in this way, the change in head shape can be reduced and the sense of discomfort at address can be eliminated.

In some particularly preferred embodiments, the mounting portion 6 is provided in an invisible position in a head plan view where the toe-side component 1B is removed from the mounting portion 6. Similarly, in some particularly preferred embodiments, as illustrated in FIG. 4, the toe-side component 1B is provided in an invisible position in a plan view of the head where the toe-side component 1B is fixed to the mounting portion 6. In this embodiment, the change in the head shape at address is substantially eliminated, and the discomfort at address can be more reliably eliminated.

Other Aspects of the Disclosure

Figure 11:
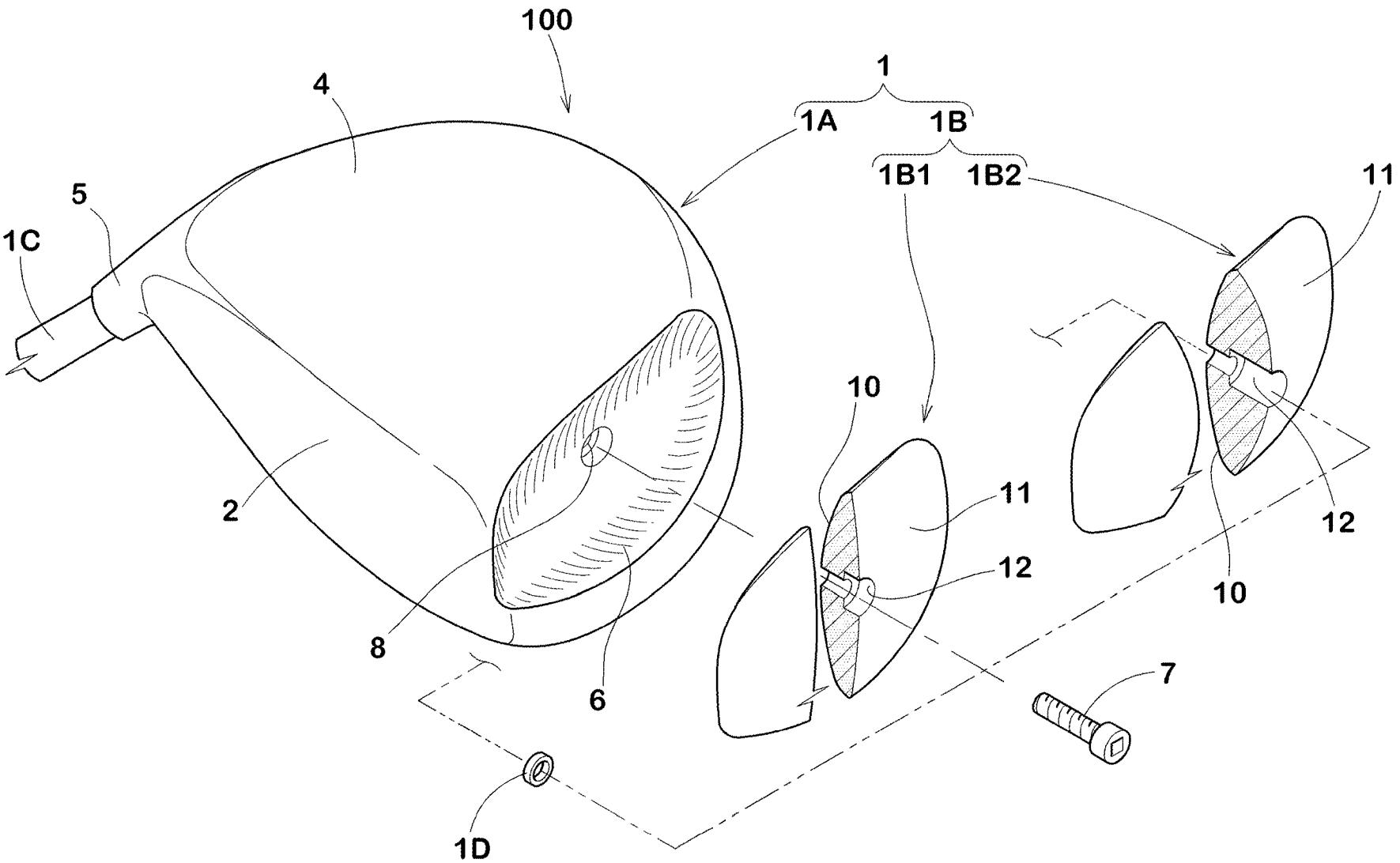
FIG. 11 is an exploded perspective of an exemplary golf club kit in accordance with one aspect of the present disclosure.

FIG. 11 illustrates an exploded perspective of an exemplary golf club kit (hereafter, simply referred to as "kit") 100 in accordance with another aspect of the present disclosure. The kit 100 includes the head main body 1A and a plurality of toe-side components 1B. Further, a golf club shaft 1C is fixed to the head main body 1A.

The configuration of the head main body 1A is as described above.

The plurality of toe-side components 1B, for example, includes at least a first component 1B1 and a second component 1B2.

The first component 1B1 and the second component 1B2, for example, have inner surfaces 10 which are the same shape as with each other. Thus, the first component 1B1 and the second component 1B2 can be fixed to the mounting portion 6 of the head main body 1A exchangably with each other using the screw 7. Note that only one of the first component 1B1 or the second component 1B2 is fixed to the mounting portion 6.

The first component 1B1 and the second component 1B2 have the outer surfaces 11 which are different in shape with each other. In the present embodiment, the outer surface 11 of the first component 1B1, for example, has a shape shown in FIG. 1, i.e., a curved surface shape that connects the crown 3 and the sole 4 with a smooth contour line. The first component 1B1 is configured to provide a first head projected area (e.g., FIG. 1) in a front view of the head when fixed to the mounting portion 6.

Figure 12:
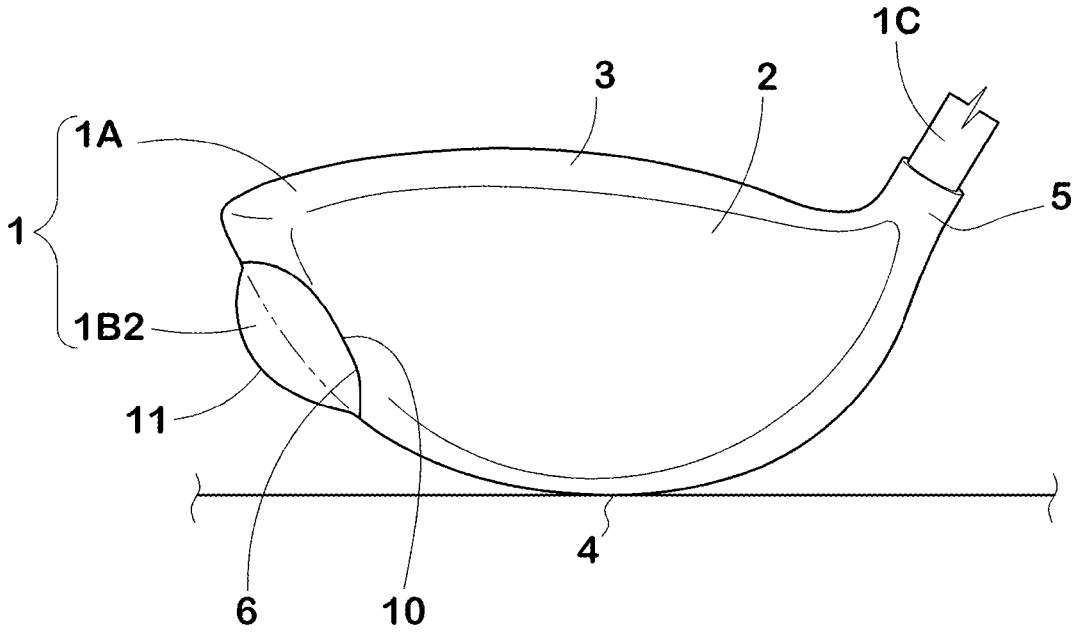
FIG. 12 is a front view of an exemplary golf club head with a second component fixed to a mounting portion of the head main body.

On the other hand, the outer surface 11 of the second component 1B2 according to the present embodiment, as shown in FIG. 12, has a curved surface shape that protrudes further toward the toe side from the smooth contour line (see the virtual line in FIG. 12) that connects the crown 3 and the sole 4. Thus, the second component 1B2 has a larger projected area in the front view than that of the first component 1B1. Thus, the second component 1B2 is configured to provide a second head projected area that is larger than the first head projected area in the front view of the head, as shown in FIG. 12 when fixed to the mounting portion 6.

In the present embodiment, the kit 100 configured as described above can be used as the head 1 as follows: use of the head main body 1A alone (hereinafter, configuration example 1); use with the first component 1B1 fixed to the head main body 1A (hereinafter, configuration example 2); and use with the second component 1B2 fixed to the head main body 1A (hereinafter, configuration example 3). Thus, in the kit 100 according to the present embodiment, air resistance of the head 1 can be adjusted in multiple steps so that the air resistance of the head 1 increases in the order of configuration example 1, configuration example 2, and configuration example 3.

In some preferred embodiments, it is desirable that the weight difference between the second component 1B2 and the first component 1B1 is small. For example, the weight difference between the first component 1B1 and the second component 1B2 is equal to or less than 10 g, more preferably equal to or less than 5 g, still further preferably equal to or less than 3 g. As a result, the total weight of the head 1 is approximated or the same in the above configuration examples 2 and 3. Thus, in this aspect, the air resistance of the head 1 can be adjusted with almost no change in the swing feeling of the golf club.

In order to make the second component 1B2 substantially the same weight as the first component 1B1, the first component 1B1 and the second component 1B2, for example, may be made of materials with different specific gravities. When the first component 1B1 and the second component 1B2 are made of the same material, the second component 1B2 may have a hollow portion therein to make the volume the same, for example. Alternatively, a weight adjusting material may be added to the first component 1B1 to make the same weight as the second component 1B2.

As illustrated in FIG. 11, the kit 100 in accordance with the present embodiment may further include a weight member 1D which has substantially the same weight as the first component 1B1. The weight member 1D in accordance with the present embodiment may be configured as a washer, for example.

The weight member 1D is fixed with the screw 7 to the screw hole 8 of the mounting portion 6 where the toe-side component 1B is not attached. In this embodiment, the configuration example 1 can also provide the same head weight as the configuration example 2 and the configuration example 3. Thus, this embodiment can provide the same head weight in configuration example 1, configuration example 2, and configuration example 3. Hence, the kit 100 of the present embodiment can adjust the air resistance of the head 1 during swing while maintaining the swing feeling of the golf club almost the same. Preferably, the weight member 1D and the screw hole 8 are configured so that the head projected area of a front view of the head main body 1A does not change regardless of whether or not the weight member 1D is attached.

In some preferred embodiment, the plurality of toe-side components 1B (e.g., the first component 1B1 and the second component 1B2) and the weight member 1D are capable of being fixed to the mounting portion 6 using the common screw 7 and the same screw hole 8. This helps reduce the number of parts and screw holes.

Although the preferred embodiments of the present disclosure have been described in detail above, the present disclosure is not limited to the above-mentioned specific embodiments, but can be modified to various aspects within the scope of claims.

Example

Hereinafter, more specific and non-limiting examples of the present disclosure will be described.

Wood-type golf clubs were manufactured based on golf club heads having the shapes of FIG. 9 (configuration example 1), FIG. 1 (configuration example 2) and FIG. 12 (configuration example 3). These golf clubs have the same golf club shaft (flex R) with each other. The specifications of each golf club head are as follows:

Head volume in a state of FIG. 1: 460 cc;

Head main body material: titanium alloy; and

Material of the toe-side components: CFRP.

Next, each golf club was attached to a swing robot and hit a ball 5 times at a head speed of 36 m/s. At that time, the face angle of the golf club head at immediately before hitting the ball was measured (n=5) using a high-speed image pickup device installed above. In Table 1, the display of "CLOSE" before the face angle value indicates that the striking face was closed, and "OPEN" indicates that the striking face was open.

Table 1 shows the test results.

TABLE 1

| | Configuration Ex. 1 | Configuration Ex. 2 | Configuration Ex. 3 |
|---|---|---|---|
| Head front view | FIG. 9 | FIG. 1 | FIG. 12 |
| Head projected area A in front view ($mm^2$) | 6600 | 6800 | 7200 |
| Ratio of head projected area A to configuration example 1 | — | 1.03 | 1.09 |
| Head projected area B in plan view ($mm^2$) | 11800 | 11800 | 12200 |
| Ratio of head projected area B to configuration example 1 | — | 1 | 1.03 |
| Face angle just before hitting ball (deg.) | CLOSE 1 deg | 0 | OPEN 1 deg |

The projected head area of the golf club head in a front view of the head is larger in the order of configuration example 1, configuration example 2 and configuration example 3, and thus the air resistance of the golf club head is also larger in this order. As a result of the test, it was confirmed that the face angle increased in this order.

What is claimed is:

1. A golf club head comprising:

a head main body; and a toe-side component, wherein the head main body comprises a striking face, a hosel portion defining a shaft center line, and a mounting portion for mounting the toe-side component on a toe side with respect to the shaft center line, the toe-side component is fixed to the mounting portion removably, and when the toe-side component is removed from the mounting portion of the head main body, a head projected area in a front view of the golf club head becomes smaller, wherein a ratio (A1/A2) of a head projected area A1 when the toe-side component is fixed to the mounting portion to a head projected area A2 when the toe-side component is removed from the mounting portion is in a range of 1.02 to 1.12.

2. The golf club head according to claim 1, wherein in the front view of the golf club head, the mounting portion has a recessed contour toward the shaft center line.

3. The golf club head according to claim 1, wherein the toe-side component is fixed to the mounting portion using a screw.

4. The golf club head according to claim 1, wherein the toe-side component comprises a low specific gravity material having a specific gravity lower than a specific gravity of the head main body.

5. The golf club head according to claim 1, wherein
a ratio (B1/B2) of a head projected area B1 in a plan view of the golf club head when the toe-side component is fixed to the mounting portion to a head projected area B2 in the plan view of the golf club head when the toe-side component is removed from the mounting portion is in a range of 1.0 to 1.05.

6. The golf club head according to claim 1, wherein
in a plan view of the golf club head where the toe-side component is removed from the mounting portion, the mounting portion is provided in an invisible position.

7. The golf club head according to claim 1, wherein
in a plan view of the golf club head where the toe-side component is fixed to the mounting portion, the toe-side component is provided in an invisible position.

8. The golf club head according to claim 1, wherein
when the golf club head with the toe-side component fixed to the mounting portion is placed on a horizontal plane, the toe-side component is provided at a position where the toe-side component does not come into contact with the horizontal plane.

9. The golf club head according to claim 1, wherein
in a front view of the golf club head, the mounting portion has an arc shape recessed toward the shaft center line.

10. The golf club head according to claim 1, wherein
the golf club head is a wood-type golf club head having a hollow therein.

11. The golf club head according to claim 1, wherein
in a front view of the golf club head, an outer surface of the toe-side component when being fixed to the mounting portion is continuous with outer surfaces of the crown and the sole of the head main body.

12. The golf club head according to claim 1, wherein
the mounting portion extend in a head front-rear direction of the golf club head.

13. A golf club kit comprising:
a head main body; and
a plurality of toe-side components, wherein
the head main body comprises a striking face, a hosel portion defining a shaft center line, and a mounting portion for mounting the toe-side component on a toe side with respect to the shaft center line,
the plurality of toe-side components is capable of fixed to the mounting portion interchangeably with each other,
the plurality of toe-side components comprises a first component and a second component,
the first component provides a first head projected area in a front view of the golf club head when fixed to the mounting portion, and
the second component provides a second head projected area that is larger than the first head projected area in a front view of the golf club head when fixed to the mounting portion.

14. The golf club kit according to claim 13, wherein
the second component has a substantially same weight as the first component.

15. The golf club kit according to claim 13, further comprising a weight member that has a substantially same weight as the first component, wherein
the weight is capable of being fixed to the mounting portion removably.

16. The golf club kit according to claim 15, wherein
the plurality of toe-side components and the weight member are capable of being fixed to the mounting portion using a common screw and a same screw hole.

17. A golf club head comprising:
a head main body; and
a toe-side component, wherein
the head main body comprises a striking face, a hosel portion defining a shaft center line, and a mounting portion for mounting the toe-side component on a toe side with respect to the shaft center line,
the toe-side component is fixed to the mounting portion removably, and
when the toe-side component is removed from the mounting portion of the head main body, a head projected area in a front view of the golf club head becomes smaller,
wherein the toe-side component comprises a low specific gravity material having a specific gravity lower than a specific gravity of the head main body.

18. A golf club head comprising:
a head main body; and
a toe-side component, wherein
the head main body comprises a striking face, a hosel portion defining a shaft center line, and a mounting portion for mounting the toe-side component on a toe side with respect to the shaft center line,
the toe-side component is fixed to the mounting portion removably, and
when the toe-side component is removed from the mounting portion of the head main body, a head projected area in a front view of the golf club head becomes smaller,
wherein a ratio (B1/B2) of a head projected area B1 in a plan view of the golf club head when the toe-side component is fixed to the mounting portion to a head projected area B2 in the plan view of the golf club head when the toe-side component is removed from the mounting portion is in a range of 1.0 to 1.05.

19. A golf club head comprising:
a head main body; and
a toe-side component, wherein
the head main body comprises a striking face, a hosel portion defining a shaft center line, and a mounting portion for mounting the toe-side component on a toe side with respect to the shaft center line,
the toe-side component is fixed to the mounting portion removably, and
when the toe-side component is removed from the mounting portion of the head main body, a head projected area in a front view of the golf club head becomes smaller,
wherein the golf club head is a wood-type golf club head having a hollow therein.

* * * * *